US005156770A

United States Patent [19]

Wetzel et al.

[11] Patent Number: 5,156,770

[45] Date of Patent: Oct. 20, 1992

[54] CONDUCTIVE CONTACT PATCH FOR A CRT FACEPLATE PANEL

[75] Inventors: Charles M. Wetzel, Lititz; Peter M. Ritt, East Petersburg; Owen H. Roberts, Jr., Landisville; Harry R. Stork, Adamstown, all of Pa.

[73] Assignee: Thomson Consumer Electronics, Inc., Indianapolis, Ind.

[21] Appl. No.: 543,314

[22] Filed: Jun. 26, 1990

[51] Int. Cl.[5] ..... H01B 1/06; H01J 31/00

[52] U.S. Cl. ..... 252/510; 313/479

[58] Field of Search ..... 252/502, 510, 500; 313/479

[56] References Cited

U.S. PATENT DOCUMENTS 4,450,379 5/1984 Kikuchi et al. ..... 313/477
4,550,032 10/1985 Campen et al. ..... 427/68
4,620,133 10/1986 Morrell et al. ..... 315/15
4,806,823 2/1989 Compen et al. ..... 313/479
4,829,212 5/1989 Serio et al. ..... 313/406
4,917,822 4/1990 Thiel et al. ..... 252/510
4,921,767 5/1990 Datta et al. ..... 430/23

*Primary Examiner*—William R. Dixon, Jr.
*Assistant Examiner*—Paul Macantoni
*Attorney, Agent, or Firm*—Joseph S. Tripoli; Dennis H. Irlbeck; Vincent J. Coughlin, Jr.

[57] ABSTRACT

A solution for making a wear-resistant conductive contact patch for a faceplate panel of a color CRT which facilitates the electrophotographic manufacturing of a luminescent screen on the panel consists essentially of, in weight percent, solvent 22 to 70, conductive material 62 to 21, and the balance being other compatible additives.

8 Claims, 3 Drawing Sheets

CONDUCTIVE CONTACT PATCH FOR A CRT FACEPLATE PANEL

The invention relates to a wear-resistant conductive contact patch for a color CRT faceplate panel and, more particularly, to a contact patch which facilitates the electrophotographic manufacturing of a luminescent screen on an interior surface of the faceplate panel.

BACKGROUND OF THE INVENTION

U.S. Pat. No. 4,921,767, issued to P. Datta et al. on May 1, 1990, discloses a method for electrophotographically manufacturing a luminescent screen assembly on an interior surface of a CRT faceplate using dry-powdered, triboelectrically charged, screen structure materials deposited on a suitably prepared, electrostatically-chargeable photoreceptor. The photoreceptor comprises a photoconductive layer overlying a conductive layer, both of which are deposited, serially, as solutions, on the interior surface of the CRT panel.

The photoreceptor is electrostatically charged by electrically contacting the conductive layer while simultaneously generating a corona discharge to suitably charge the photoconductive layer. Preferably, the conductive layer is grounded while a positive corona discharge is generated from a corona charger which is moved across the photoconductive layer. The conductive layer is relatively thin, on the order of about 1 to 2 microns, and must be contacted a number of different times during screen processing. Experience has shown that repeated contacts with the thin conductive layer by the ground contact of the charging apparatus erodes the contacted portion of the conductive layer and, thus, a need exists for a more wear-resistant contact.

SUMMARY OF THE INVENTION

In accordance with the present invention, a solution for making a conductive contact patch for a faceplate panel of a color CRT which facilitates the electrophotographic manufacturing of a luminescent screen on the panel consists essentially of, in weight percent, solvent 22 to 70, conductive material 62 to 21, and the balance being other compatible additives.

DETAILED DESCRIPTION OF THE PREFERRED EMBODIMENT

Figure 1:
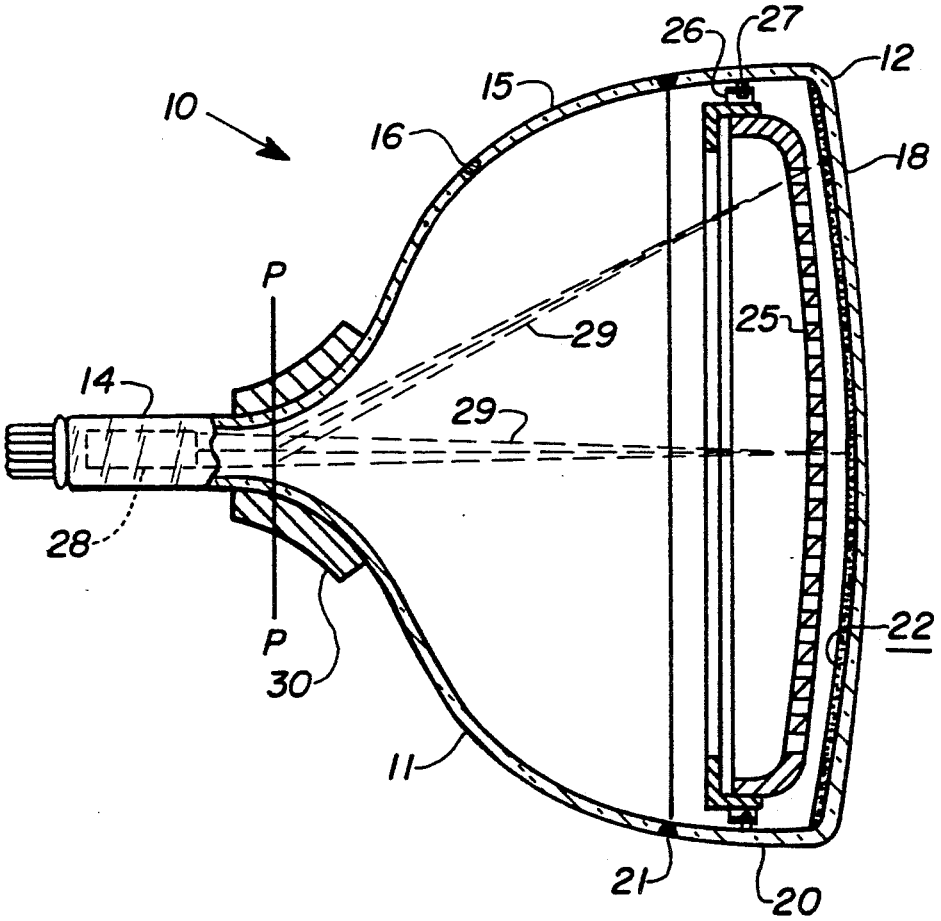
FIG. 1 is a plan view, partially in axial section, of a color CRT made utilizing the present invention.
Figure 2:
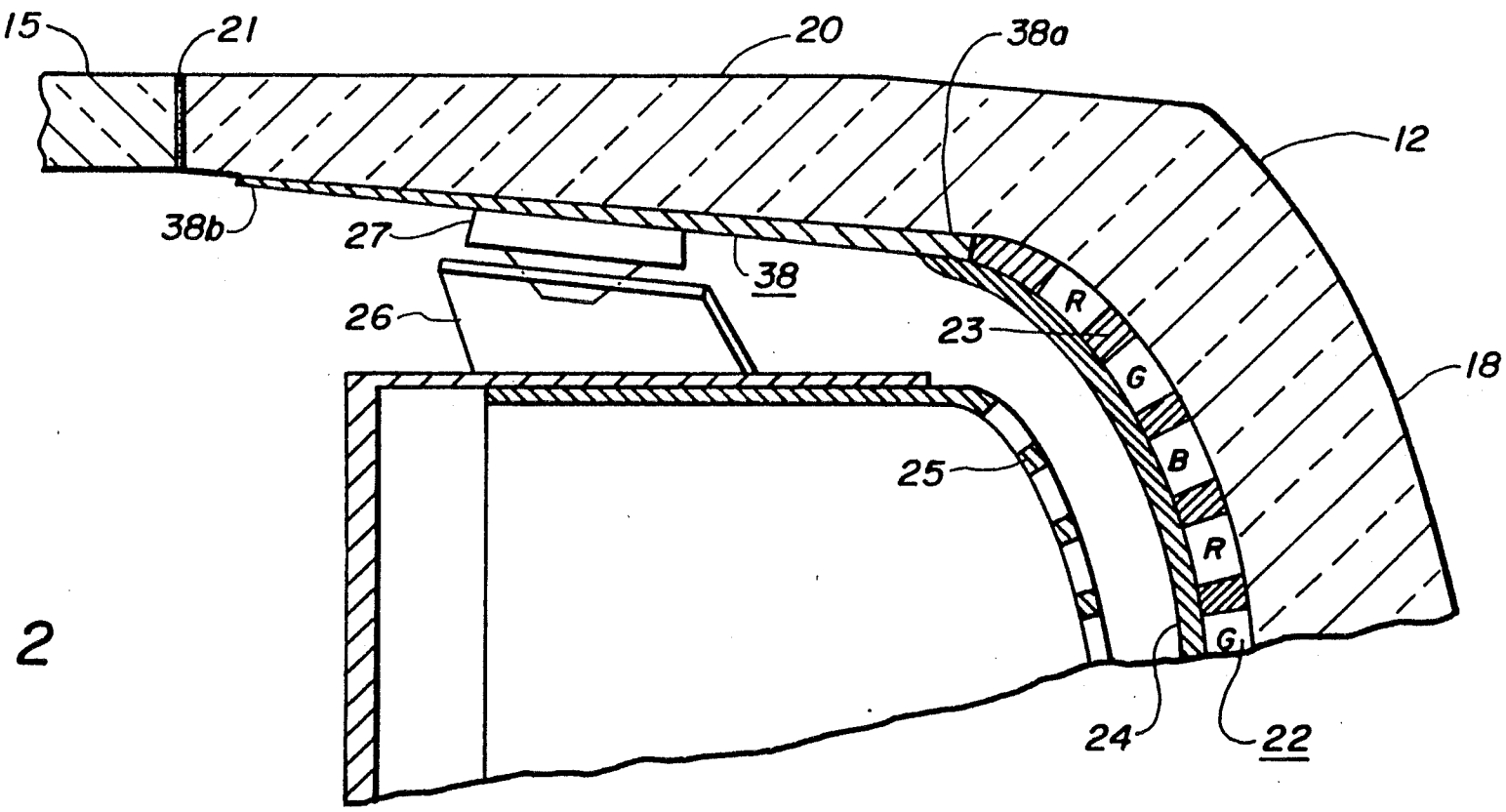
FIG. 2 is a section of the tube of FIG. 1 showing details of the luminescent screen assembly.

FIG. 1 shows a color CRT 10 having a glass envelope 11 comprising a rectangular faceplate panel 12 and a tubular neck 14 connected by a rectangular funnel 15. The funnel 15 has an internal conductive coating (not shown) that contacts an anode button 16 and extends into the neck 14. The panel 12 comprises a viewing faceplate or substrate 18 and a peripheral flange or sidewall 20, which is sealed to the funnel 15 by a glass frit 21. A three color phosphor screen 22 is carried on the inner surface of the faceplate 18. The screen 22, shown in FIG. 2, preferably is a line screen which includes a multiplicity of screen elements comprised of red-emitting, green-emitting and blue-emitting phosphor stripes R, G and B, respectively, arranged in color groups or picture elements of three stripes or triads in a cyclic order and extending in a direction which is generally normal to the plane in which the electron beams are generated. In the normal viewing position of the embodiment, the phosphor stripes extend in the vertical direction. Preferably, the phosphor stripes are separated from each other by a light-absorptive matrix material 23, as is known in the art. Alternatively, the screen can be a dot screen. A thin conductive layer 24, preferably of aluminum, overlies the screen 22 and provides a means for applying a uniform potential to the screen as well as for reflecting light, emitted from the phosphor elements, through the faceplate 18. The screen 22 and the overlying aluminum layer 24 comprise a screen assembly.

With respect again to FIG. 1, a multi-apertured color selection electrode or shadow mask 25 is removably mounted in predetermined spaced relation to the screen assembly, by conventional means comprising a plurality of spring members 26 each attached to a stud 27 embedded in the sidewall 20. An electron gun 28, shown schematically by the dashed lines in FIG. 1, is centrally mounted within the neck 14, to generate and direct three electron beams 29 along convergent paths, through the apertures in the mask 25, to the screen 22. The gun 28 may be, for example, a bi-potential electron gun of the type described in U.S. Pat. No. 4,620,133, issued to Morrell et al., on Oct. 28, 1986, or any other suitable gun.

The tube 10 is designed to be used with an external magnetic deflection yoke, such as yoke 30 located in the region of the funnel-to-neck junction. When activated, the yoke 30 subjects the three beams 29 to magnetic fields which cause the beams to scan horizontally and vertically in a rectangular raster over the screen 22. The initial plane of deflection (at zero deflection) is shown by the line P—P in FIG. 1, at about the middle of the yoke 30. For simplicity, the actual curvatures of the deflection beam paths in the deflection zone are not shown.

Figure 3:
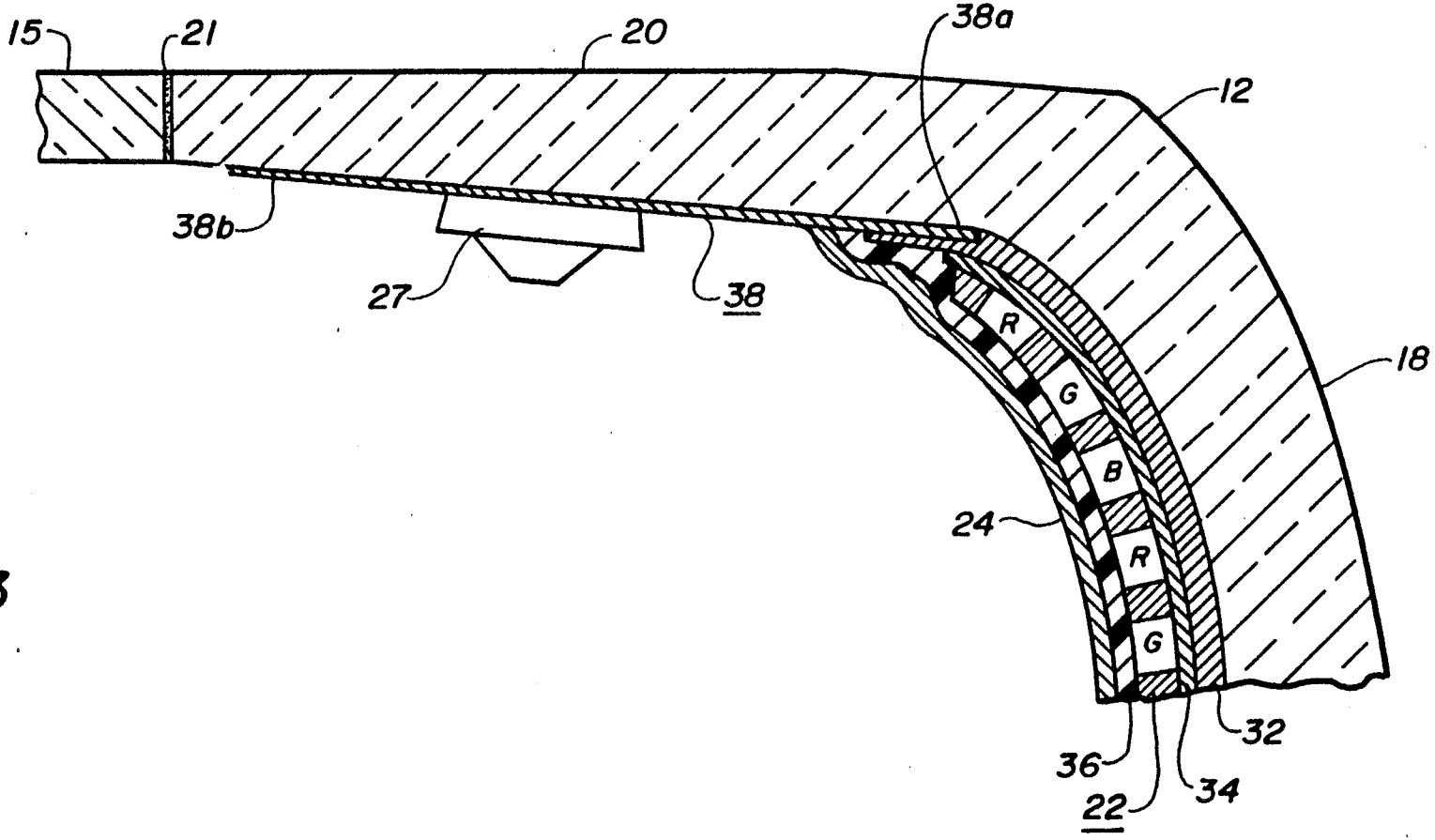
FIG. 3 shows the screen assembly of FIG. 2 during a step in the manufacturing process.

The screen 22 is manufactured by an electrophotographic process that is described in the above-mentioned U.S. Pat. No. 4,921,767 which is incorporated by reference herein for the purpose of disclosure. Initially, the panel 12 is washed with a caustic solution, rinsed with water, etched with buffered hydrofluoric acid and rinsed once again with water, as is known in the art. The interior surface of the viewing faceplate 18 is then coated with a first solution and dried to form a layer 32 of a volatilizable, electrically conductive material which provides an electrode for an overlying volatilizable, conductive layer 34 that is formed by applying a second solution. Portions of the layers 32 and 34, which together comprise a photoreceptor, are shown in FIG. 3. The composition and method of forming the conductive layer 32 and the photoconductive layer 34 are described in U.S. Pat. No. 4,921,767. Typically, the conductive layer 32 has a thickness within the range of about 1 to 2 microns and the photoconductive layer 34 has a thickness within the range of about 3 to 4 microns.

The conductive layer 32 is grounded and the overlying photoconductive layer 34, is uniformly charged in a dark environment by a corona discharge apparatus which charges the photoconductive layer 34 within the range of +200 to +700 volts. The shadow mask 25 is inserted into the panel 12, and the positively-charged photoconductor is exposed, through the shadow mask, to the light from a xenon flash lamp disposed within a conventional lighthouse (not shown). After each exposure, the lamp is moved to a different position, to duplicate the incident angle of the electron beams from the electron gun. Three exposures are required, from three different lamp positions, to discharge the areas of the photoconductor where the light-emitting phosphors subsequently will be deposited to form the screen. After the exposure step, the shadow mask 25 is removed from the panel 12, and the panel is moved to a first developer (also not shown). The first developer contains suitably prepared dry-powdered particles of a light-absorptive black matrix screen structure material which is negatively charged by the developer. The conductive layer is again grounded and negatively-charged matrix particles are expelled from the developer and attracted to the positively-charged, unexposed area of the photoconductive layer 34 to directly develop that area.

The photoconductive layer 34, containing the matrix 23, is uniformly recharged by the discharge apparatus to a positive potential, as described above, for the application of the first of three triboelectrically charged, dry-powdered, color-emitting phosphor screen structure materials. The shadow mask 25 is reinserted into the panel 12 and selected areas of the photoconductive layer 34, corresponding to the locations where green-emitting phosphor material will be deposited, are exposed to light from a first location within the lighthouse to selectively discharge the exposed areas. The first light location approximates the incidence angle of the green phosphor-impinging electron beam. The shadow mask 25 is removed from the panel 12, and the panel is moved to a second developer. The second developer contains e.g., dry-powdered particles of green-emitting phosphor screen structure material. The green-emitting phosphor particles are positively-charged by, and expelled from, the developer, repelled by the positively-charged areas of the photoconductive layer 34 and matrix 23, and deposited onto the discharged, light exposed areas of the photoconductive layer, in a process known as reversal developing.

The processes of charging, exposing and developing are repeated for the dry-powdered, blue- and red-emitting, phosphor particles of screen structure material. The exposure to light, to selectively discharge the positively-charged areas of the photoconductive layer 34, is made from a second and then from a third position within the lighthouse, to approximate the incidence angles of the blue phosphor- and red phosphor-impinging electron beams, respectively. The triboelectrically positively-charged, dry-powdered phosphor particles are expelled from a third and then a fourth developer, repelled by the positively-charged areas of the previously deposited screen structure materials, and deposited onto the discharged areas of the photoconductive layer 34, to provide the blue- and red-emitting phosphor elements, respectively.

The screen structure materials, comprising the black matrix material and the green-, blue-, and red-emitting phosphor particles are electrostatically attached, or bonded, to the photoconductive layer 34. The adherence of the screen structure materials can be increased by directly depositing thereon an electrostatically charged dry-powdered filming resin from a fifth developer as described in U.S. Pat. No. 5,028,501, issued on Jul. 2, 1991, and incorporated by reference herein for the purpose of disclosure. The conductive layer 32 is grounded during the deposition of the resin. A substantially uniform positive potential of about 200 to 400 volts is applied to the photoconductive layer and to the overlying screen structure materials using the discharge apparatus, prior to the filming step, to provide an attractive potential and to assure a uniform deposition of the resin which, in this instance, would be charged negatively. The resin is an organic material with a low glass transition temperature/melt flow index of less than about 120° C., and with a pyrolyzation temperature of less than about 400° C. The resin is water insoluble, preferably has an irregular particle shape for better charge distribution, and has a particle size of less than about 50 micron. The preferred material is n-butyl methacrylate; however, other acrylic resins, such as methyl methacrylates and polyethylene waxes, may be used. Between about 1 and 10 grams, and typically about 2 grams, of powdered filming resin is deposited onto the screen surface 22 of the faceplate 18. The faceplate is then heated to a temperature of between 100° to 120° C. for about 1 to 5 minutes using a suitable heat source to melt or fuse the resin and to form a substantially continuous film 36 which bonds the screen structure materials to the faceplate 18. Alternatively, the filming resin may be fused by a suitable chemical vapor. The film 36 is water insoluble and acts as a protective barrier if a subsequent wet-filming step is required to provide additional film thickness or uniformity. If sufficient dry-filming resin is utilized, the subsequent wet-filming step is unnecessary. An aqueous 2 to 4 percent, by weight, solution of boric acid or ammonium oxalate is oversprayed onto the film 36 to form a ventilation-promoting coating (not shown). Then the panel is aluminized, as is known in the art, and baked at a temperature of about 425° C. for about 30 to 60 minutes or until the volatilizable organic constituents are driven from the screen assembly. The ventilation-promoting coating begins to bake-out at about 185° C. and produces small pin holes in the aluminum layer 24 which facilitate removal of the organic constituents without blistering the aluminum layer.

To ensure that electrical contact to the conductive layer 32 is established and maintained during the charging, developing and dry filming steps in the electrophotographic screening process and to monitor the deposition of the triboelectrically charged materials, at least one novel conductive contact patch 38 is provided along an interior portion of the sidewall 20. Preferably, the contact patch 38 extends from a peripheral portion of the interior surface, adjacent to the viewing faceplate 18, to near the frit seal edge of the panel and has a substantially rectangular shape with a width of about 5 cm. Preferably, the contact patch 38 is applied to the sidewall 20 before the solution which forms the conductive layer 32 is coated on the interior surface of the faceplate 18. The contact patch 38 is insoluble in the solutions which form the conductive layer 32 and the photoconductive layer 34. Also, the contact patch is not removed by the 425° C. baking step which volatilizes the layers 32, 34 and the resin film 36. The contact patch 38 includes a first portion **38*a* which underlies at least a portion of the conductive layer 32 and is in electrical contact therewith, and a second portion 38*b* which extends therefrom and makes electrical contact with one of the studs 27 to provide a means for electrically interconnecting the shadow mask 25 and the aluminum layer 24 overlying the screen 22**.

The contact patch 38 may be formed of any suitable metal film, conductive epoxy, organic or water-based conductor which is resistant to abrasion from the electrical contacts and is insoluble in the solutions which form the layers 32 and 34. The conductive contact patch 38 may be applied by depositing an evaporated metal film, by painting, spraying or any other conventional means of deposition. The thickness of the contact patch 38 thus depends on the material and method of application.

The contact patch 38, preferably, is formed by applying a solvent-based solution to two separate areas of the sidewall 20. One of the areas includes one of the studs 27. The contact patch-forming solution is applied either by painting or spraying through a stencil and care is required to prevent the solution from extending into the viewing area of the faceplate 18 or onto the edge of the panel which is sealed by the glass frit 21 to the funnel 15. Typically, the solvent-based contact patch 38 has a thickness of about 8000 to 13000Å and a resistance less than 250 ohms, and, preferably within the range of 150 to 250 ohms.

A solution for making the conductive contact patch 38 consists essentially of the following ingredients, in weight percent:

| | |
|---|---|
| solvent | 22 to 70 |
| conductive material | 62 to 21 |
| other compatible additives | balance |

The formulation for the contact patch-forming, solvent-based solution consists essentially of the following materials, in weight percent:

| | |
|---|---|
| 5% o-phosphoric acid | 1.0 to 3.0 |
| tetraethylsilicate | 5.2 to 11.2 |
| toluene | 3.2 to 13.2 |
| acetone | 5.2 to 11.2 |
| amyl acetate | 5.2 to 11.2 |
| methanol | 5.2 to 11.2 |
| ethanol | 2.0 to 8.0 |
| conductive material | 62 to 42 |

A suitable conductive material is a graphite-based material such as Acheson Dag 154 manufactured by the Acheson Colloids Co., Port Huron, Mich.

The preferred formulation for the above-described solvent-based solution, in weight percent, is:

| | |
|---|---|
| 5% o-phosphoric acid | 2.0 |
| tetraethylsilicate | 8.2 |
| toluene | 8.2 |
| acetone | 8.2 |
| amyl acetate | 8.2 |
| methanol | 8.2 |
| ethanol | 5.0 |
| Acheson Dag 154 | 52.0 |

An alternative water-based solution for forming the contact patch 38 consists essentially of the following materials, in weight percent:

| | |
|---|---|
| surfactant | 8 to 12 |
| conductive material | 39 to 19 |
| water | balance |

More specifically, the preferred aqueous solution consists essentially of the following materials, in weight percent:

| | |
|---|---|
| conductive material | 29 |
| surfactant | 10 |
| pH adjuster | 11 |
| DI water | 50 |

The preferred conductive material is graphite containing a sufficient quantity of a colloidal silica dioxide, such as LUDOX (trade name) manufactured by E. I. duPont, Wilmington, Del. or its equivalent, to prevent aggregation. The surfactant is L-72 Pluronic, or its equivalent, manufactured by BASF Wyandotte Corp., Parsippany, N.J. The pH adjuster is ammonium hydroxide and it is added to maintain a pH within the range of 3.5 to 7.5, 5.5 being preferred. When a water-based solution is used to form the contact patch 38, the patch is formed after the conductive layer 32 is applied to the surface of the substrate, but before the photoconductive layer 34 is formed.

What is claimed is:

1. A graphite-containing, solvent-based solution for making a wear-resistant, conductive contact patch for a faceplate panel of a color CRT which facilitates the electrophotographic manufacturing of a luminescent screen on an interior surface of said faceplate, said solvent-based solution having a concentration consisting of essentially of the following ingredients, in weight percent:

| | |
|---|---|
| 5% o-phosphoric acid | 1.0 to 3.0 |
| toluene | 3.2 to 13.2 |
| acetone | 5.2 to 11.2 |
| amyl acetate | 5.2 to 11.2 |
| methanol | 5.2 to 11.2 |
| ethanol | 2.0 to 8.0 |
| graphite | 62 to 42 and |
| tetraethylsilicate | 5.2 to 11.2 |

2. The solvent-based solution as described in claim 1 wherein the concentration, in weight percent, of said 5% o-phosphoric acid is 2; each of said tetraethylsilicate, toluene, acetone, amyl acetate and methanol is 8.2; said ethanol is 5 and said graphite is 52.

3. A graphite-containing, water-based solution, having a pH within the range of 3.5 to 7.5, for making a wear-resistant conductive contact patch for a faceplate of a color CRT which facilitates the electrophotographic manufacturing of a screen on an interior surface of said faceplate consisting essentially of the following ingredients having a concentration, in weight percent, of:

| | |
|---|---|
| [surfactant] colloidal silica dioxide | 8 to 12 |
| [conductive material] graphite | 39 to [19] 21 |
| water | balance. |

4. The water-based solution as described in claim 3 further including ammonium hydroxide as a pH modifier.

5. The water-based solution as described in claim 4 wherein said ammonium hydroxide comprises about 11 weight percent of said solution.

6. The water-based solution as described in claim 3 wherein the concentration, in weight percent is:

| | |
|---|---|
| colloidal silica dioxide | 10 |

-continued

| | |
|---|---|
| graphite | 29 |
| water | balance |

7. The water-based solution as described in claim 6 further including ammonium hydroxide as a pH modifier sufficient to maintain the pH within the range of 3.5 to 7.5.

8. The water-based solution as described in claim 7 wherein said ammonium hydroxide comprises about 11 weight percent of said solution.

* * * * *

UNITED STATES PATENT AND TRADEMARK OFFICE

CERTIFICATE OF CORRECTION

PATENT NO. : 5,156,770

DATED : Oct. 20, 1992

INVENTOR(S) : Charles M. Wetzel et al.

It is certified that error appears in the above-identified patent and that said Letters Patent is hereby corrected as shown below:

Col. 6, line 54, delete "[surfactant]".

Col. 6, line 55, delete "[conductive material]" and "[19]".

Signed and Sealed this

Twelfth Day of October, 1993

*Attest:*

*Attesting Officer*

BRUCE LEHMAN

*Commissioner of Patents and Trademarks*